US009834009B2

(12) United States Patent
Till

(10) Patent No.: US 9,834,009 B2
(45) Date of Patent: Dec. 5, 2017

(54) ROTATING HANDLING CAROUSEL HAVING COLLISION AVOIDANCE CONTROL

(71) Applicant: TILL GMBH, Kelkheim (Taunus) (DE)

(72) Inventor: Volker Till, Hofheim am Taunus (DE)

(73) Assignee: TILL GMBH, Kelkheim (Taunus) (DE)

( * ) Notice: Subject to any disclaimer, the term of this patent is extended or adjusted under 35 U.S.C. 154(b) by 0 days.

(21) Appl. No.: 15/022,225

(22) PCT Filed: Sep. 12, 2014

(86) PCT No.: PCT/EP2014/069545

§ 371 (c)(1),
(2) Date: Mar. 16, 2016

(87) PCT Pub. No.: WO2015/036566

PCT Pub. Date: Mar. 19, 2015

(65) Prior Publication Data

US 2016/0229197 A1 Aug. 11, 2016

(30) Foreign Application Priority Data

Sep. 16, 2013 (DE) ..... 10 2013 110 161

(51) Int. Cl.
*B41J 3/407* (2006.01)
*B67C 7/00* (2006.01)
(Continued)

(52) U.S. Cl.
CPC ..... *B41J 3/4073* (2013.01); *B67C 7/0046* (2013.01); *B41F 17/22* (2013.01); *B41J 11/0015* (2013.01)

(58) Field of Classification Search
CPC ... B41J 3/4073; B41J 11/0015; B67C 7/0046; B41F 17/22
See application file for complete search history.

(56) References Cited

U.S. PATENT DOCUMENTS

2008/0044510 A1 2/2008 Doudement
2010/0200362 A1 8/2010 Gillet et al.
(Continued)

FOREIGN PATENT DOCUMENTS

DE 19933847 A1 1/2001
EP 0071068 A1 2/1983
(Continued)

*Primary Examiner* — Henok Legesse
(74) *Attorney, Agent, or Firm* — Leydig, Voit & Mayer, Ltd.

(57) ABSTRACT

A rotating handling carousel includes a transfer device arranged on the outer circumference of the handling carousel. The transfer device includes a carry-along element which receives and transports an article and a guide element. The guide element is arranged in such a way that the article transported by the carry-along element is guided into or out of a handling station, for which the guide element extends into an area of the handling station in such a way that the guide element does not collide with the handling device at the transfer position. A sensor detects whether a handling device or the article are not in the transfer position, and/or whether the article is located in the handling station at all, and, after such a determination, issues a collision signal based on a kind of the transfer device.

14 Claims, 7 Drawing Sheets

(51) Int. Cl.
*B41J 11/00* (2006.01)
*B41F 17/22* (2006.01)

(56) References Cited

U.S. PATENT DOCUMENTS

| | | | | |
|---|---|---|---|---|
| 2012/0151883 | A1 | 6/2012 | Klarl et al. | |
| 2012/0260955 | A1* | 10/2012 | Winzinger | B29C 49/4205 134/43 |
| 2013/0313081 | A1 | 11/2013 | Krulitsch et al. | |
| 2014/0158504 | A1* | 6/2014 | Fahldieck | B65G 47/847 198/867.05 |

FOREIGN PATENT DOCUMENTS

| | | | |
|---|---|---|---|
| EP | 2465814 | A1 | 6/2012 |
| EP | 2511205 | A2 | 10/2012 |
| FR | 2937619 | A1 | 4/2010 |
| WO | WO 2007025908 | A1 | 3/2007 |
| WO | WO 2008129346 | A1 | 10/2008 |
| WO | WO 2009060256 | A1 | 5/2009 |
| WO | WO 2012107172 | A1 | 8/2012 |

* cited by examiner

ROTATING HANDLING CAROUSEL HAVING COLLISION AVOIDANCE CONTROL

CROSS-REFERENCE TO PRIOR APPLICATIONS

This application is a U.S. National Stage Application under 35 U.S.C. §371 of International Application No. PCT/EP2014/069545 filed on Sep. 12, 2014, and claims benefit to German Patent Application No. DE 10 2013 110 161.5 filed on Sep. 16, 2013. The International Application was published in German on Mar. 19, 2015 as WO 2015/036566 A1 under PCT Article 21(2).

FIELD

The invention relates to a rotating handling carousel with preferably several handling stations rotating with the handling carousel arranged at the outer circumference of the handling carousel for the handling of articles. According to an embodiment of the invention, the handling stations are in particular printing stations, labeling station or filling stations for bottles, cans or similar containers which are arranged on a rotating handling carousel, wherein handling takes place during the rotation of the handling carousel and the containers are fed and removed to and from the handling station through related feeding and removal devices.

BACKGROUND

For the transfer, the movements of the handling carousel and the carry-along element of the transfer device are matched to each other in such a way that the transfer device guides an article to the transfer position when a handling station is located there. For filling, labeling and/or printing of bottles, such handling carousels are known.

These known solutions have in common that during handling, form-fitting overlaps between bottle and handling device exist preventing a damage-free removal of the bottle. Either the bottle is fixed by the lowered handling device, so that the handling device and/or the fixed bottle collide with the guide element of the transfer device, or the bottle is vertically displaced to a handling position, so that a lifting device of the handling device for vertically shifting the bottle collides with the guide element. Such a collision would result in severe damage to the handling stations and/or transfer devices causing long repair periods and thus downtimes of the handling carousel.

WO 2012/107172 A1 describes a container handling machine for bottles or similar containers with a plurality of handlings stations, wherein between two adjacent handling machines at least one container transfer station is located. The handling machine comprises sensors and a driving mechanism to detect an increased diameter of the handling machine or transfer station as a result of heat expansion and to compensate such increase by shifting the complete transfer station.

EP 0 071 068 A1 describes a device for sorting faulty containers out of a transport flow, where a testing station checks passing containers for specified criteria and controls a diverter that diverts the faulty containers out of the transport flow.

EP 2 465 814 A1 is a transport device for feeding containers to a handling device transporting the containers along a specified transport path, where along the transport path an alignment device is provided, which aligns containers in part with respect to an angular position along its longitudinal axis by means of a guide.

EP 2 511 502 A2 describes a container handling machine with at least one gripper that is transported compulsorily for the handling of a container during transport, pick-up or removal along a specific transport distance.

WO 2009/060256 A1 describes a detection device to detect a faulty position of a container in a handling machine, which comprises an alarm sensor coupled with a trigger. When the trigger actuates the alarm sensor the movement of the container is stopped.

Due to the mass of the machines involved, in particular the handling carousel, and the usual handling speed of 20 bottles per second, an emergency stop normally does not result in an in-time standstill avoiding a collision. The movements are usually controlled via cam disks, which, independently of the handling result and possible disturbances in the handling station, force the transfer device to feed and remove the bottles. Thus if e.g. an (incorrectly dimensioned) bottle is jammed in a filling or printing station or the handling device in the carousel is not moved out from a collision position in due time before reaching a transfer position for the feeding or removal of bottles, many handling stations are destroyed before the machine comes to a standstill by means of an emergency stop. Due to the self-locking effect, the compulsory cam disk guide also does not allow the use of servomotor-driven guides, with which greater damage could be prevented.

SUMMARY

In an embodiment, the present invention provides a rotating handling carousel that includes handling stations formed as at least one of printing stations, labeling stations or filling stations arranged on an outer circumference of the handling carousel and rotating with the handling carousel for handling of articles formed as at least one of bottles, cans or similar containers, by a handling device. One article is locatable in at least one of the handling station or the handling device at a transfer position or handling position. At least one transfer device is arranged on the outer circumference of the handling carousel not rotating with the handling carousel. The transfer device is configured to transfer the articles between the transfer device and the handling station at the transfer position of the handling station. The transfer device comprises at least one carry-along element configured to receive and transport at least one of the articles and at least one guide element. The guide element is arranged in such a way that the article transported by the carry-along element is guided into or out of the handling station, for which the guide element extends into an area of the handling station in such a way that the guide element does not collide with the handling device at the transfer position of at least one of the articles or the handling device. The movement of the handling carousel and the carry-along element of the transfer device are matched with each other in such a way that the transfer device guides the article to the transfer position when a handling station is located there. The guide element has a low weight compared to a remaining part of the handling carousel. A sensor is configured to detect whether, during an approach of the handling station to the transfer device, at least one of the handling device or the article are not in the transfer position and/or whether the article is located in the handling station at all, and, after such a determination, to issue a collision signal based on a kind of the transfer device. The transfer device is configured as at least one of a removal device for removal of articles from the handling station to the transfer device or a feeding device for supply of articles from the transfer device to the handling station. In the case the transfer device is configured as the removal device, it is checked whether the handling device or the article is not at the transfer position. In the case the transfer device is configured as the feeding device, it is checked whether the handling device is not at the transfer position or whether the article is located in the handling station. A control is configured to move the guide element away from the area of the handling station upon the sensor indicating the collision signal.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
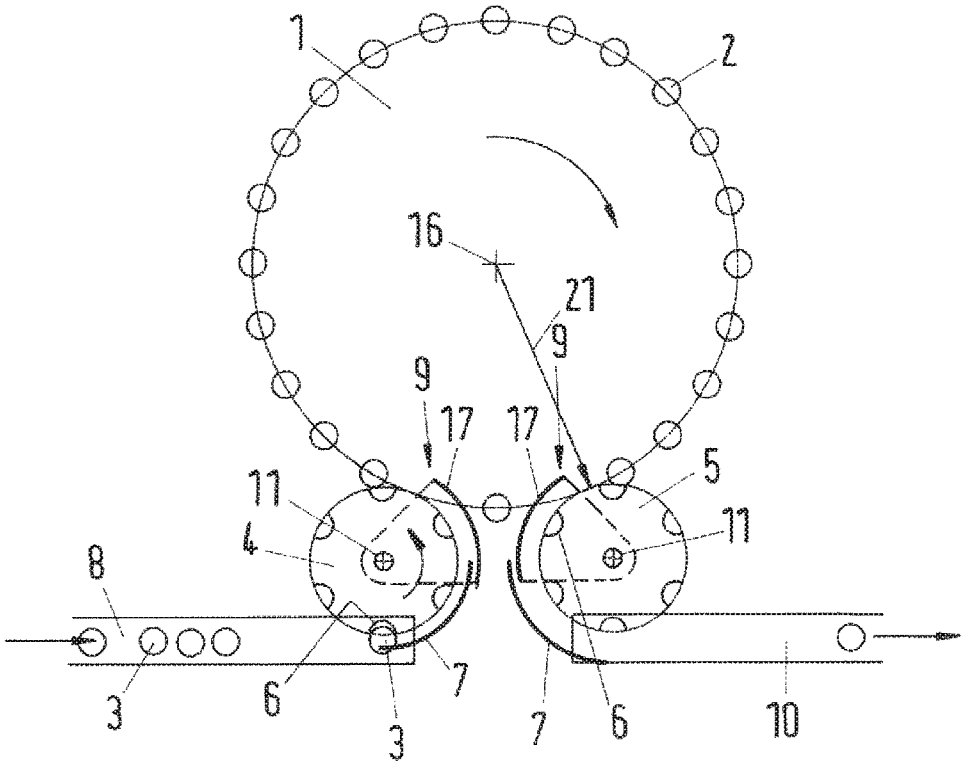
FIG. 1 schematically a handling carousel according to an embodiment of the invention, which is formed as a carousel with printing stations, in a view from above.

The article is handled in one of the several handling stations preferably evenly distributed at the outer circumference of the handling carousel by means of a handling device. Particularly preferred applications are a rotating handling carousel for bottles, cans or similar containers which are labeled, printed or filled in the handling station. The handling devices therefore are labeling devices, printing devices or filling devices or stations respectively.

The article in its handling station and/or handling device may be in a transfer position, in particular feeding and removal position, into which the article is transferred before handling or after handling, or a handling position, at which the article is handled. For instance, the handling device may be, as in a filling station for bottles with a filling valve, be moved toward the article, that is, in particular lowered or lifted vertically. In another arrangement, the article may be arranged in a shiftable manner or be shifted vertically to the handling device, that is, in direction of the axis of rotation of the handling carousel by means of a lifting device, which is part of the handling device, while the handling carousel rotates and the article is handled by the handling device.

According to an embodiment of the invention, a transfer device not rotating with the handling carousel for the transfer of, that is, for feeding or removing, the articles between the transfer device and the handling station at/in the transfer position is provided at or in front of the outer circumference of the handling carousel, thus when the article and/or the handling device are in the transfer position of the handling station and when one of the handling stations and the transfer device are opposite each other at the outer circumference of the handling carousal.

Such a transfer device has at least one carry-along element for receiving and transporting at least one article, and at least one guide element, wherein the guide element is arranged so that an article transported by the carry-along element is guided into or out of the handling station, for which the guide element reaches into a area of the handling stations in such a manner that it does not collide with the handling device in the transfer position of the articles and/or the handling device. For this, the guide element can be arranged in the transfer position of the handling station in particular in the vertical direction between a base of the articles and the handling station. For this, either the handling device can for instance be pulled upwards, or the article can be lowered by means of a lifting device, at the upper end of which is located the base for the articles.

In an embodiment, the invention provides a handling carousel of the above-mentioned type, in which, even in the case of a disturbance, collisions between the transfer device and the handling stations of the handling carousel can be avoided before the handling carousel and/or the transfer device come to a standstill by an emergency stop.

In an embodiment, a sensor is provided in particular which is suitable and adapted to determine if, when the handling station approaches a transfer device or one of the transfer devices, the handling device and/or an article received in the handling station is not located in the transfer position in the transfer position, or if an article is even located in the handling station, and to issue a collision signal with such a determination—depending on the kind of the transfer device and the applicable criterion.

Depending or based on the kind of the transfer device means that, in the case of a removal device, it is checked whether the handling device or an article is not located in the transfer position. In the case of a feeding station, it can be checked whether the handling device is not located in a transfer position or whether an article is located in the handling station, as, in this case, a new article can also not be fed into the handling station. Correspondingly, a sensor arranged in front of a feeding device and a removal device can be set up differently and apply different criteria for issuing a collision signal.

Further, a control is provided according to an embodiment of the invention which moves the guide element or the several guide elements of the transfer mechanism out from the area of the handling station as soon as the sensor indicates the collision signal.

According to an embodiment of the invention, the guide elements may be in particular fixed parts of the transfer device in normal operation, which can, by a special movement mechanism, also be guided independently out of the collision area by the for instance forcibly guided movement in normal operation by means of a cam guide, in particular because these guides often only have a low mass compared to the remainder of the machine. An effective collision avoidance is possible hereby.

In a particularly preferred embodiment of the handling carousel suggested according to the invention, the handling device has a lifting device, in particular a servo lifting device, by means of which the article is arranged in a vertically shiftable manner to a handling station which is stationary apart from this.

According to a further preferred embodiment, the transfer device of the handling carousel may be formed as an independently rotating star-shaped shaft, on the outer circumference of which are formed recesses for receiving and transporting respectively an article as carry-along elements, and which has a guide rail arranged opposite the recesses as a guide element, which is arranged so that an article received in a recess of the star-shaped shaft object is guided into and out of the treatment station during the rotation of the star-shaped shaft.

The rotational speeds of the handling carousel and the star-shaped shaft are thereby matched to one another so that a recess at the circumferential edge of the star-shaped shaft and a transfer position of a handling station on the circumference of the handling carousel meet respectively. In particular, the star-shaped shaft and the handling carousel can rotate in opposite directions with the same circumferential speed. This is a particularly effective way to feed and remove articles, such as bottles, in filling, labeling or printing stations.

For the guide element of the transfer device reaching into the area of the handling station, which would collide with parts of the handling station in the case of a handling device not located in the transfer position or of an article not located in the transfer position, it is provided that it is, in the case of an imminent collision, unscrewed out of the handling station area about an axis, in particular about the axis of rotation of the star-shaped shaft. Such a rotational movement can be realized quickly and without large space requirements.

According to a preferred further development of the handling carousel according to an embodiment of the invention, the transfer device, in particular the star-shaped shaft, may have a bottom guide arranged preferably horizontally, for instance located in the rotational plane of the star-shaped shaft, on which an article received by the carry-along element stands and is transported to the transfer position. Depending on the arrangement of the facility, the bottom guide can of course also be arranged obliquely. The control is now set up to hinge the bottom guide downward about a hinge axis during a collision signal of the sensor, so that the article falls down from the carry-along element and is not guided to the handling station. This is particularly sensible in case of a transfer device designed as a feeding station.

When, as preferably provided according to an embodiment of the invention, the guide rail engaging the handling station as well as the bottom guide is removed in case of an imminent collision, in particular are moved out and/or are hinged, at a feeding station, the articles are, with a transfer device performing an arcuate feeding movement, guided away from the handling station by the centrifugal force as well as by gravity.

In a particularly advantageous further development of the bottom guide according to an embodiment of the invention, this may be at least partially formed in a circular or arc-shaped manner. The hinge axis for hinging the bottom guide during a risk of collision can then correspond to an axis within the circular or arc-shaped bottom guide. The mass of the guide to be moved can be kept small hereby, so that the part of the bottom guide to be does not have a high inertia.

In order to accelerate the removal of the guide elements, it can be provided that the guide element or the guide elements are held against a bias, in particular a spring bias, in their operating position, and that, in case of a collision signal from the sensor, a release takes place, so that the released guide element is abruptly removed from its operating position.

According to an embodiment of the invention, an actuator may additionally (or alternatively) be provided, which is, in case of a collision signal from the sensor, adapted to trigger a chemical reaction by which an in particular additional force for moving away the guide element, in particular for moving the guide rail away from the area of the handling station and/or the hinging of the bottom guide is generated. Such an actuator may be a blasting cap with a defined blasting effect so that no damages result at the handling station and/or the transfer device.

Furthermore, it can be provided according to an embodiment of the invention that the outer dimensions of the handling device, in particular of the lifting device of the handling device in the case of a lifting or lowering of the article into the handling station, in a position, in which a part of the handling device, in particular a part of the lifting device, if necessary with the exception of the base for the article, is located in the area of the transfer position in which a collision with the guide element, in particular the guide calendar of the transfer device would take place, is smaller than the inner area of a carry-along element of the transfer device. This corresponds to a smaller outer contour than the usually handled article. This effects that no collision takes place between the lifting device located in the handling position or another part of the handling device and the carry-along element of the transfer device in the case of a disturbance.

According to an embodiment of the invention, the control may further be adapted to initiate an emergency stop of the handling carousel and of the transfer device or all transfer devices arranged on the handling carousel, wherein the emergency stop of the handling carousel and the transfer device is preferably matched to one another in such a manner that, during the movement of the handling carousel and the carry-along element slowing down to standstill, the carry-along element is always in a transfer position when a handling station is located there, that is, in the transfer position.

In the case of a star-shaped shaft, this can mean in particular that the transfer device and the handling carousel respectively have the same circumferential speeds, even during braking. In this manner, a collision with a for instance improperly lowered lifting device or with an article still present in the area of the feeding device, which was removed improperly in a removal device, is avoided. Preferably, another part of the handling device is also formed in such a manner that it does not collide directly with a guide element of the transfer device, even during the handling.

On the outer circumference of the handling carousel 1 are formed handling stations 2, which are shown schematically in FIG. 1 as a circle. Articles 3, in particular bottles, received in the handling carousel 1 are handled in these handling or printing stations 2, thus printed in a printing station 2, while the handling carousel 1 is rotated in the direction of the arrow shown in the handling carousel.

The articles 3 are fed to or removed again from the handling stations 2 of the handling carousel 1 by transfer devices 4, 5. The transfer devices 4, 5 are fixedly arranged on the outer circumference of the handling carousels 1 and do not rotate with the handling carousel 1.

In the illustrated example, the transfer device 4 is formed as a feeding station for bottles 3 and the transfer device 5 as a removal station for the bottles. For this, the transfer devices 4, 5 respectively have carry-along elements 6, in which the bottles 3 are partially received, so that the bottle 3 received in the carry-along element 6 is transported during a movement of the carry-along element. For this, the carry-along element 6 cooperates with a guide element 7 arranged opposite the carry-along element 6, which guides the bottle 3 during the movement of the carry-along element 6 from a feed conveyor 8 to a transfer position 9 in the handling station 2, as illustrated for feeding station 4.

In the removal station 5, the carry-along element 6 correspondingly engages the bottle 3 in the transfer position 9 of the handling station 2 and transports the bottle 3 by sliding along the guide element 7 to a removal conveyor.

In the illustrated example, the transfer devices 4, 5 are formed as independently rotating star-shaped shafts, on the outer circumference of which are formed recesses as carry-along elements for receiving and transporting of respectively a bottle 3. The guide element 7, 17 is arranged so that a bottle 3 received in a recess 6 of the star-shaped shaft is guided into or out of the handling station 2 during the rotation of the star-shaped shaft.

The rotational speeds of the handling carousel 1 and the transfer devices or star-shaped shafts 4, 5 are matched to one another in such a manner that respectively one recess 6 meet at the circumferential edge of the star-shaped shaft 4, 5 and a transfer position 9 at the circumferential edge of the carousel handling 1.

Figure 2A:
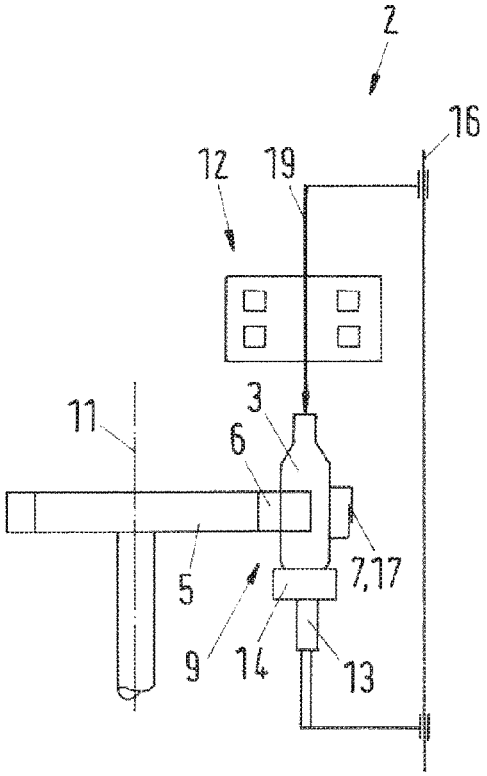
FIG. 2*a* schematically a handling station in the transfer position in a side view.
Figure 2B:
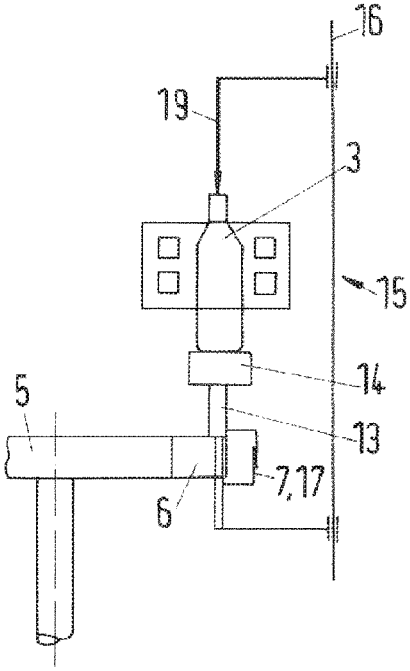
FIG. 2*b* schematically a handling station in the handling position in a side view.
Figure 3:
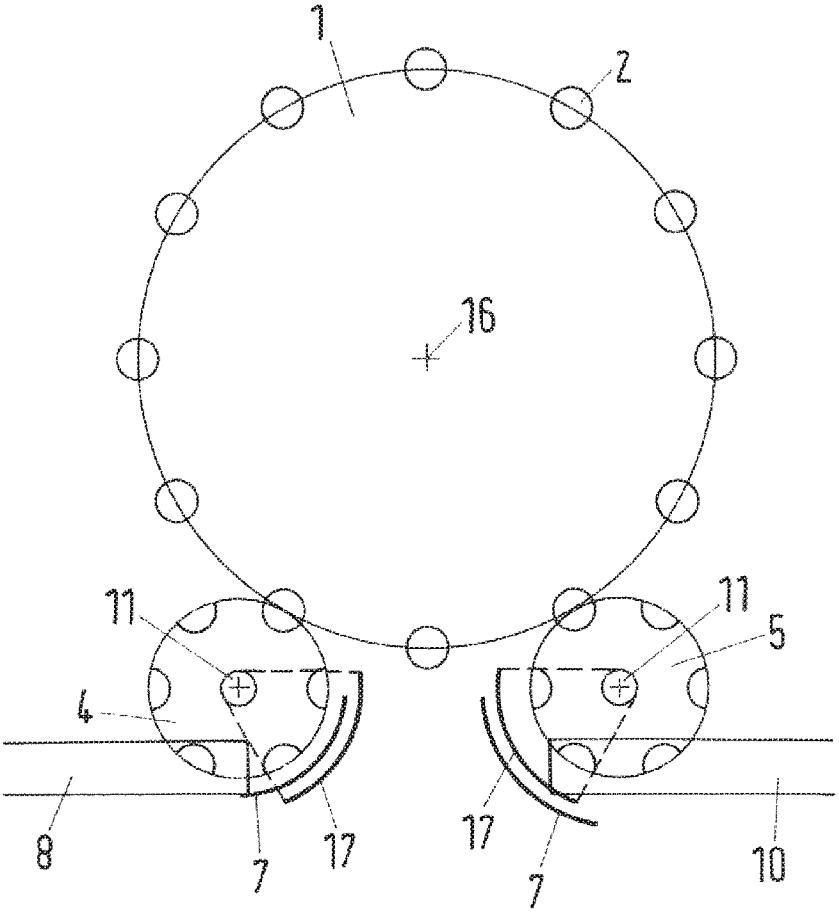
FIG. 3 schematically the illustration according to FIG. 1 with guide elements pulled out from the area of the handling station.

In FIGS. 2*a* and 2*b*, a handling station 2 of the handling carousel 1 is illustrated in the area of the removal station 5 in a side view in an exemplary manner. FIG. 2*a* shows a bottle 3 in the transfer position 9, in which the bottle 3 engages the recess 6 of the removal star-shaped shaft 5 as a transfer device, which rotates about the axis of rotation 11 of the transfer device 5 formed as a star-shaped shaft. During the rotation, the bottle 3 received in the recess 6 is rotated jointly and guided along the guide element 17, 7 formed as a guide rail, so that the bottle 3 is removed from the handling station 2 of the handling carousel 1.

The illustrated handling station 2 is a printing station having a print head assembly 12 as a handling device, which is illustrated in FIGS. 2*a* and *b* above the bottle 3. So that the bottle 3 can be printed in the print head assembly 12, the handling device consisting of the print head assembly 12 further has a servo lifting device 13 with a rotary table formed as a base 14, on which the bottle is received in the handling station 2. With this lifting device 13, the bottle 3 is displaced vertically, that is, in the direction of the axis of rotation 16 of the handling carousel 1, from the transfer position 9 illustrated in FIG. 2*a* into the handling position 15 illustrated in FIG. 2*b*, in the illustrated example upwards. In the handling position 15, the bottle 3 with the area to be printed is in the print head assembly 12 in which the bottle 3 is rotated past the print heads by means of the rotary table 14 and a rotary fixing 19.

This occurs during the rotation of the handling carousel 1, when the printing station 2 is located between the feeding station 4 and the removal station 5.

If now, as illustrated in FIG. 2*b*, due to a disturbance, the bottle 3 and the lifting device 13 are still located in the handling position 15 when approaching the removal station 5, the lifting device 13 will collide with the guide rail 17, 7, which shall guide a bottle 3 in the transfer position 9 out of the handling station 2.

In order to avoid this, the transfer devices 4, 5 according to an embodiment of the invention have, in addition to the stationary part of the guide rail 7, also have a movably mounted guide rails 17 which may be withdrawn from the area of the handling station 2 in the case of such a disturbance. For this, the movably mounted guide rail 17 can be rotated about the axis of rotation 11 of the transfer device 4, 5, wherein said movably mounted guide rail 17 of a transfer device 4, 5 is latched in the normal position illustrated in FIG. 1 in a spring-biased manner, so that, during a release of the latch in the case of a disturbance, the movably mounted guide rail 17 is moved out from the area of handling station 2, in particular instantaneously or very quickly.

The case of disturbance can be determined by means of a sensor (or several sensors), which is arranged in the direction of rotation of the handling carousel 1 immediately in front of the transfer devices 4 and/or 5. In front of the removal station, the sensor can in particular determine whether the lifting device 13 is arranged in the transfer position 9, so that a bottle 3 arranged on the base 14 of the lifting device 13 bottle 3 engages the recess 6 of the removal station 5 formed as a star-shaped shaft, shaft discharge station. If this is not the case, a collision signal is issued, which causes the retraction of the movably mounted guide rails 17 of the feeding device 4 and also of the of the removal device 5.

Correspondingly, a sensor may also be arranged in front of the feeding device 4, which determines whether the lifting device 13 is in the transfer position and no bottle 3 is located in the transfer position 9 of the handling station 2. If this is not the case, the movably mounted guide rail 17, preferably of the feeding device 4 as well as of the removal device 5 is moved out of the area of the handling station 2.

Such sensors can be position sensors, for instance mechanically or electrically or electromagnetically operating proximity sensors, or also optical sensors, for instance cameras. These are known in principle and are correspondingly used by experts as needed.

Figure 4:
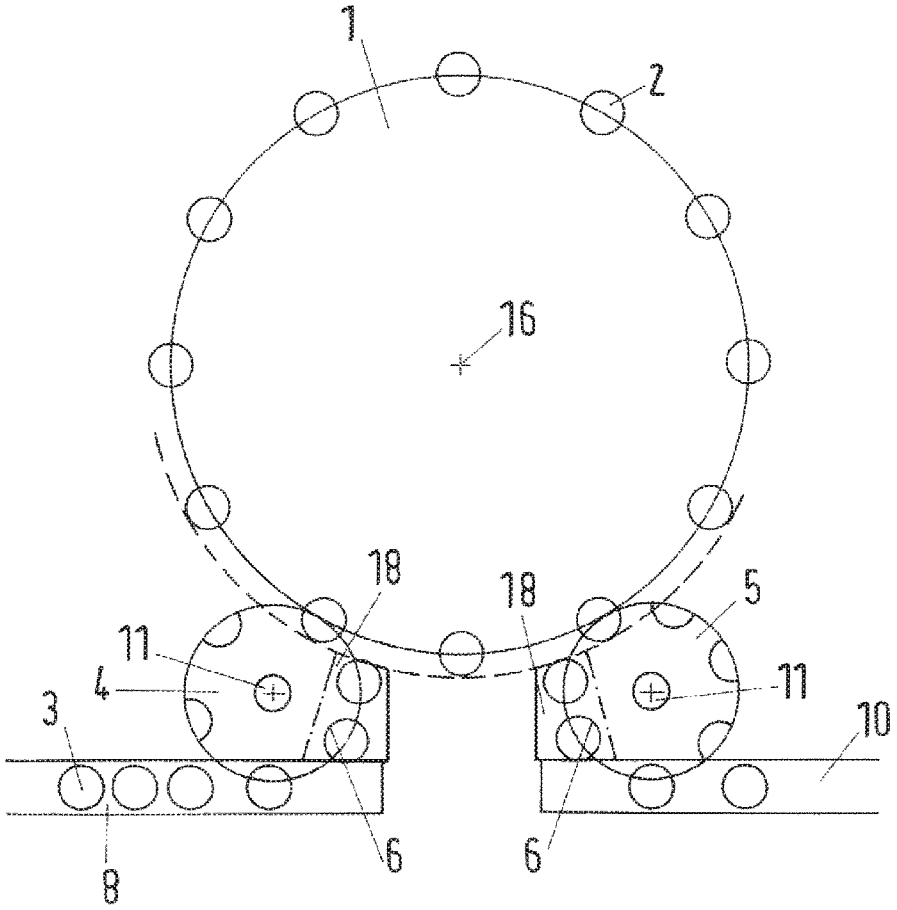
FIG. 4 schematically the illustration according to FIG. 1 with hinged bottom guides provided in the transfer devices.

As a further guide element 18, a bottom guide 18, arranged horizontally in the illustrated example, is provided on the transfer devices 4, 5, as illustrated in FIG. 4, on which stands a bottle 3 received by the carry-along element 6 during regular transport. So that, in case of a collision signal indicated by the sensor, the bottles or articles 3 accumulated or which have been accumulated are removed, it is provided according to an embodiment of the invention to hinge this bottom guide 18 downward by a control in the case of a collision.

Figure 5:
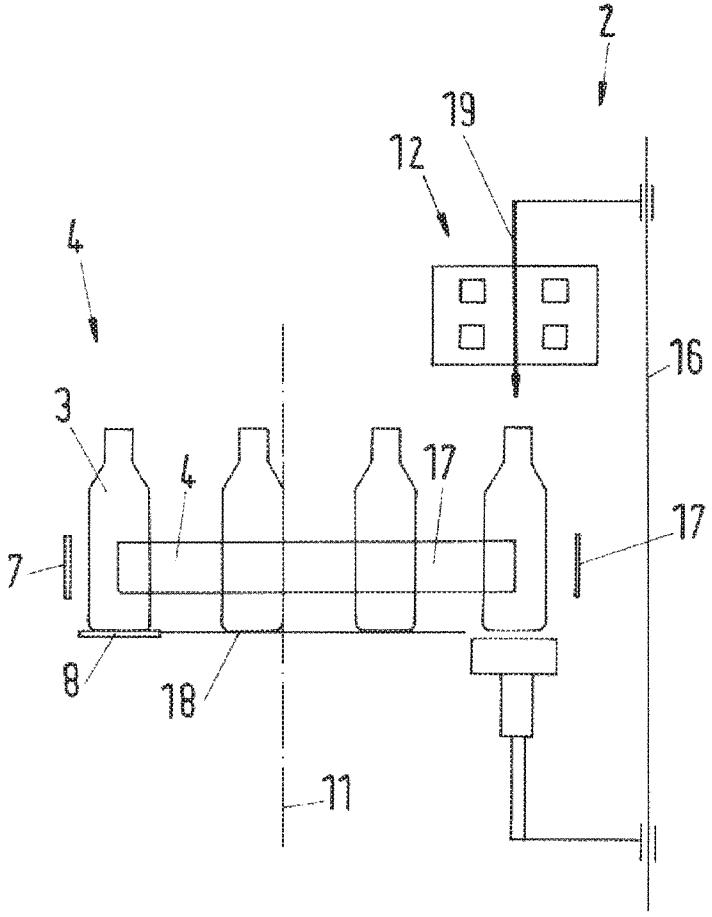
FIG. 5 schematically the hinged bottom guide in the side view.

In FIG. 5, the hinged bottom guide 18 of the feeding device 4 is illustrated in the side view, which shows how bottles 3 are guided into the handling station 2 along the guide rail 7, 17 via the hinged bottom guide 18.

Figure 6:
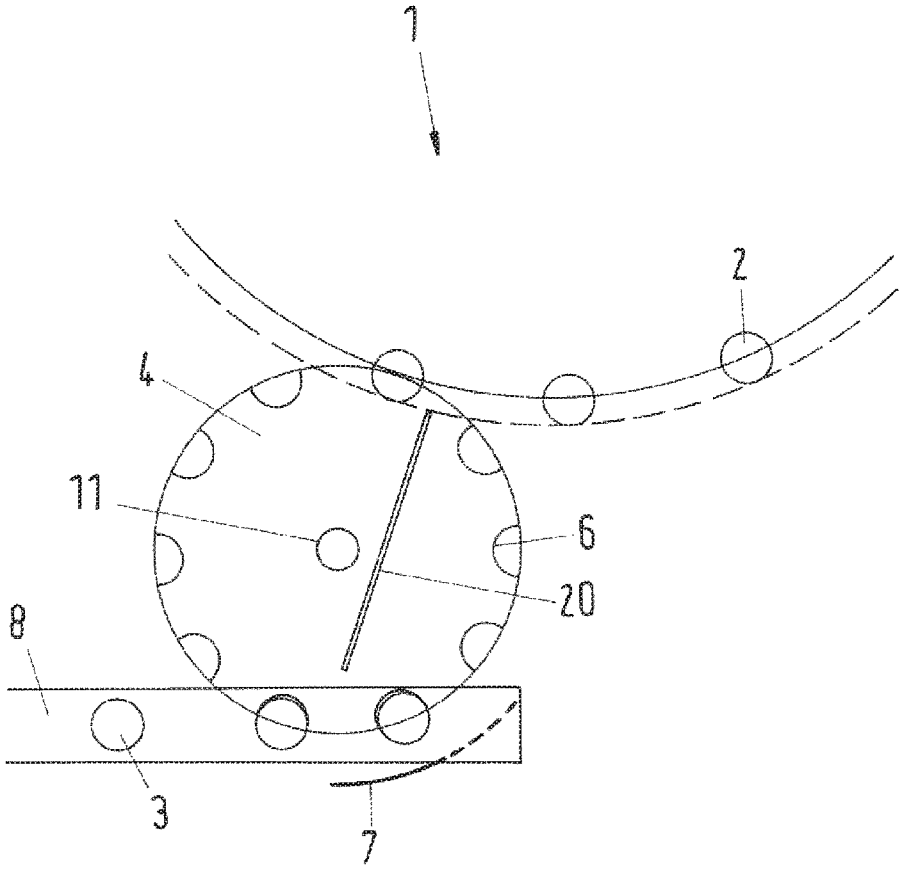
FIG. 6 schematically the hinge axis of the bottom guide.

In case of a disturbance, this bottom guide is 18 hinged downward via a hinge axis 20 formed as a hinge, as illustrated in FIG. 6, so that the bottles or articles 3 fall down from the carry-along element 6 of the transfer device 4, 5.

Figure 7:
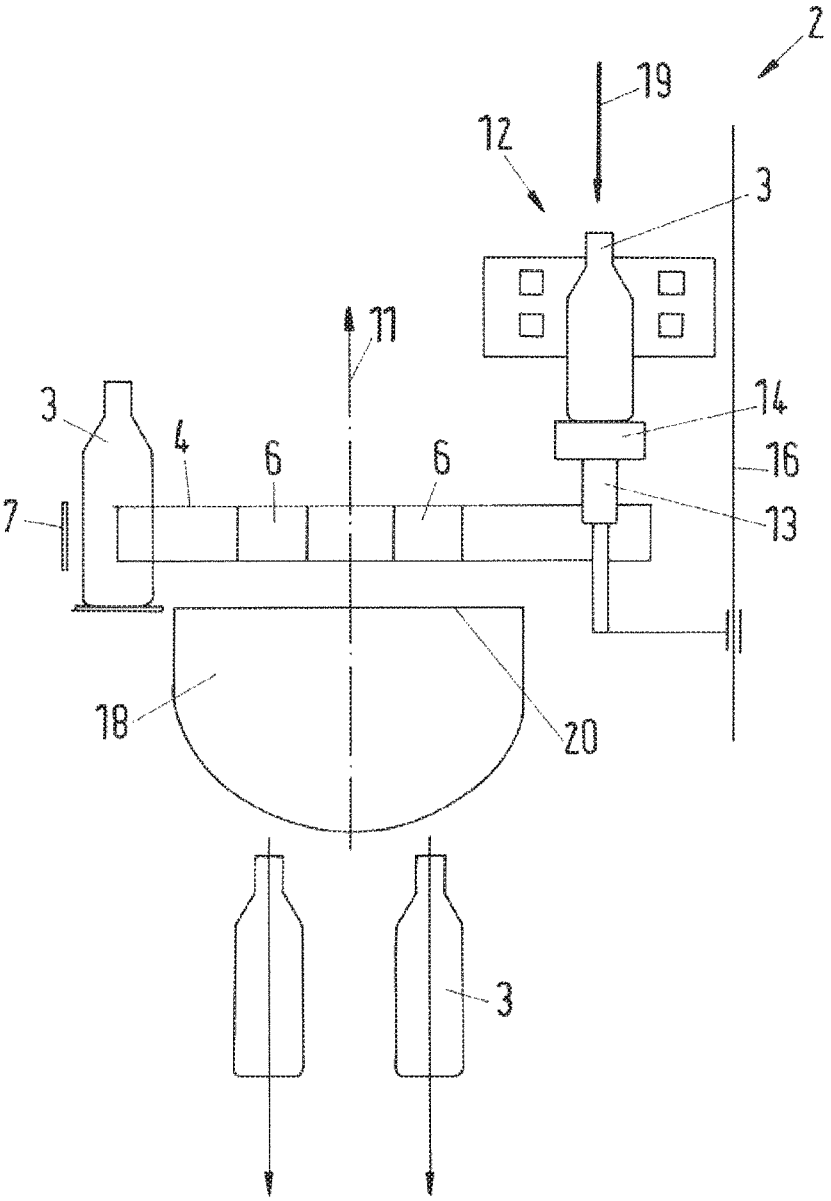
FIG. 7 schematically the hinged bottom guide in the side view according to FIG. 5.

This is illustrated in FIG. 7 for the case of a collision, in which the movably mounted guide rail 17 is also pulled from the area of the handling station 2.

As can be seen for instance in FIG. 2, it is further suggested according to an embodiment of the invention the lifting device 13 is designed smaller in diameter than the bottle 3 with the smallest diameter, so that the lifting device 13 will not collide with the transfer device 5 in the case of a disturbance, as it can be performed by the carry-along element 6.

If, for instance, a possible collision is determined by the sensor and a collision signal is issued at the detection point 21 (see FIG. 1), a control according to an embodiment of the invention is set up, to withdraw the movably mounted guide rails 17 of the transfer devices 4, 5 as quickly and in time from the area of the handling stations 2, so that a wrongly positioned bottle 3 is not forcibly removed and thereby an overlap for instance with the lifting device 13 (or in another embodiment with a filling valve), does not cause a collision.

It is simultaneously provided to feed no further bottles 3 to the feeding device 4, as the bottle 3 which is not removed would otherwise lead to a collision with the newly fed bottle 32 in the handling station 2. It is provided here according to an embodiment of the invention to initially stop the intake of further bottles into the feeding device 4 by the control. Simultaneously, the movably mounted guide rail 17 of the feeding station 4 is also retracted so that a disturbance during the continuation of the handling carousel 1 also does not abut this guide rail 17.

In addition, the bottom guide 18 serving as a bottle support surface is hinged downward. Thereby, the bottles still present in the feeding station 4 (inlet star) neither have an outer guide (guide rail 17) nor a support surface (bottom guide 18) holding them. Thereby they are ejected from the transfer device due to centrifugal forces and by gravity and cannot cause any collisions in the handling stations 2 of handling carousel 1.

The handling carousel 1 suggested according to embodiments of the invention with the safety devices for avoiding collisions during disturbances thus enables that the machines can phase out slowly without destroying themselves with an emergency stop initiated when recognizing a disturbance.

The retraction of the movable mounted guide rail 17 and/or the hinging of the bottom guide 18 may be supported by a spring force or by an actuator by means of an explosive force, similar to an airbag in a car.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 Handling carousel, printing carousel
2 Handling stations, printing stations
3 Object, bottle
4 Transfer device, feeding device
5 Transfer device, removal device
6 Carry-along element, recess
7 Guide element, guide rail
8 Feeding conveyor
9 Transfer position
10 Removal conveyor
11 Axis of rotation of the transfer device formed as a star-shaped shaft
12 Print head assembly, handling device
13 Lifting device, part of the handling device
14 Base, rotary table
15 Handling position
16 Axis of rotation of the handling carousel
17 movably mounted guide rail
18 Bottom guide, further guide element
19 Rotary fixing
20 Hinge axis, hinge
21 Detection point

The invention claimed is:

1. A rotating handling carousel, comprising:

handling stations formed as at least one of printing stations, labeling stations or filling stations arranged on an outer circumference of the handling carousel and rotating with the handling carousel for handling of articles formed as at least one of bottles, cans or similar containers, by a handling device, wherein one article is locatable in at least one of the handling station or the handling device at a transfer position or handling position;

at least one transfer device arranged on the outer circumference of the handling carousel not rotating with the handling carousel, the transfer device being configured to transfer the articles between the transfer device and the handling station at the transfer position of the handling station, wherein the transfer device comprises at least one carry-along element configured to receive and transport at least one of the articles and at least one guide element, wherein the guide element is arranged in such a way that the article transported by the carry-along element is guided into or out of the handling station, for which the guide element extends into an area of the handling station in such a way that the guide element does not collide with the handling device at the transfer position of at least one of the articles or the handling device, and wherein the movement of the handling carousel and the carry-along element of the transfer device are matched with each other in such a way that the transfer device guides the article to the transfer position when a handling station is located there, the guide element having a low weight compared to a remaining part of the handling carousel;

a sensor configured to determine whether, during an approach of the handling station to the transfer device, the handling device is not in the transfer position, and, after such a determination, to issue a collision signal; and a control configured to move the guide element away from the area of the handling station upon the sensor indicating the collision signal.

2. The rotating handling carousel according to claim 1, wherein the transfer device is formed as an independently rotating, star-shaped shaft with recesses on an outer circumference as the carry-along elements configured to receive and transport one article each, and which comprises a guide rail as the guide element opposite the recesses arranged in such a way that the article received in a respective recess of the star-shaped shaft is guided during the rotation of the star-shaped shaft into or out of the handling station, and wherein a rotational speed of the handling carousel and the star-shaped shaft are matched to each other in such a way that the respective recess at a circumferential edge of the star-shaped shaft always meets the transfer position at a circumferential edge of the handling carousel.

3. The rotating handling carousel according to claim 1, wherein the guide element is unscrewed out of the handling station area about an axis.

4. The rotating handling carousel according to claim 1, wherein the transfer device comprises, as another guide element, a bottom guide, upon which the article is located which is picked up by the carry-along element, and wherein the control is so designed to swing the bottom guide downwards along a swing-down axis in the event of the collision signal of the sensor.

5. The rotating handling carousel according to claim 4, wherein the bottom guide has an either circular or arched form and wherein the swing-down axis corresponds to a chord within the circular or arched bottom guide.

6. The rotating handling carousel according to claim 1, wherein the guide element is biased in an operating position to be released in the event of the collision signal of the sensor.

7. The rotating handling carousel according to claim 1, further comprising an actuator configured to release, in the event of the collision signal of the sensor, a chemical reaction generating a force to move the guide element away.

8. The rotating handling carousel according to claim 7, wherein the actuator is a blasting cap.

9. The rotating handling carousel according to claim 1, wherein outer dimensions of the handling device in a position, in which a part of the handling device is in an area of the transfer position, are smaller than an inner area of the carry-along element.

10. The rotating handling carousel according to claim 1, wherein the control is configured to start an emergency stop of the handling carousel and the transfer device.

11. The rotating handling carousel according to claim 10, wherein the emergency stop of the handling carousel and the transfer device are matched to each other in such a way that the carry-along element always is at the transfer position when a respective handling station is located there as well during a slowing-down movement up to a standstill of the handling carousel and the transfer device.

12. The rotating handling carousel according to claim 1, wherein the sensor is configured to determine whether the article located in the handling station is not in the transfer position so as to determine whether the handling device is not in the transfer position.

13. The rotating handling carousel according to claim 12, wherein the transfer device is configured as a removal device for removal of the articles from the handling station to the transfer device.

14. The rotating handling carousel according to claim 1, wherein the transfer device is configured as a feeding device for supply of the articles from the transfer device to the handling station, and wherein the sensor is configured to determine whether one of the articles is located in the handling station and, after such a determination, to issue a collision signal.

* * * * *